US005382063A

United States Patent [19]

Wesener et al.

[11] Patent Number: 5,382,063

[45] Date of Patent: Jan. 17, 1995

[54] WASTE PRODUCT COLLECTION DEVICE

[76] Inventors: Lois D. Wesener; Randall M. Crawford, both of 2424 E. Morgan Ave., Milwaukee, Wis. 53207

[21] Appl. No.: 228,959

[22] Filed: Apr. 18, 1994

Related U.S. Application Data

[63] Continuation of Ser. No. 986,583, Dec. 7, 1992, abandoned.

[51] Int. Cl.[6] ..... A01K 29/00; E01H 1/12

[52] U.S. Cl. ..... 294/1.3; 15/257.6; 294/55

[58] Field of Search ..... 294/1.3–1.5, 294/9, 49, 55; 15/104.8, 257.1, 257.2, 257.4, 257.6, 257.7, 257.9

[56] References Cited

U.S. PATENT DOCUMENTS

| | | | |
|---|---|---|---|
| 741,640 | 10/1903 | Ernst | 294/55 |
| 953,756 | 4/1910 | Olson | 15/257.6 |
| 1,762,347 | 6/1930 | Pebbles | 294/55 |
| 2,666,309 | 1/1954 | Anderson et al. | 294/55 X |
| 3,431,008 | 3/1969 | Narita | 294/1.4 |
| 3,703,158 | 11/1972 | Lemler | 294/1.3 |
| 3,804,448 | 4/1974 | Schmieler | 294/1.4 |
| 3,937,509 | 2/1976 | Hufnagel | 294/1.4 |
| 3,986,744 | 10/1976 | Krogstad et al. | 294/1.3 |
| 4,021,994 | 5/1977 | Mainprice | 294/1.4 |
| 4,103,952 | 8/1978 | Thompson | 294/1.3 |
| 4,149,745 | 4/1979 | Willis | 294/1.4 |
| 4,154,389 | 5/1979 | Dell'Anno | 15/257.1 X |
| 4,257,635 | 3/1981 | Mainprice | 294/1.4 |
| 4,316,627 | 2/1982 | Solypa | 294/1.4 |
| 4,447,082 | 5/1984 | Lindholm | 294/1.4 |
| 4,641,873 | 2/1987 | Nurnberger | 294/1.4 |
| 4,645,252 | 2/1987 | Riley | 294/1.4 |
| 4,686,734 | 8/1987 | Kahan | 294/55 X |
| 5,156,427 | 10/1992 | Longrie et al. | 294/1.3 |

FOREIGN PATENT DOCUMENTS

| | | | |
|---|---|---|---|
| 176814 | 4/1986 | European Pat. Off. | 294/1.4 |
| 2708503 | 8/1978 | Germany | 294/1.3 |
| 102501 | 2/1924 | Switzerland | 294/55 |
| 672873 | 1/1990 | Switzerland | 294/1.3 |
| 879048 | 10/1961 | United Kingdom | 294/55 |
| 946533 | 1/1964 | United Kingdom | 294/55 |
| 1021750 | 3/1966 | United Kingdom | 15/257.2 |

*Primary Examiner*—Johnny D. Cherry

*Attorney, Agent, or Firm*—Andrus, Sceales, Starke & Sawall

[57] ABSTRACT

A waste pick-up device includes a tubular body formed of a suitable plastic with a concave bottom wall, sidewalls and a top wall. A front opening includes an inclined edge to provide a protruding bottom lip, which is flexible such that by pressing on the top of the body portion, the lip is deflected to firmly engage the ground while permitting smooth movement over the ground. A transparent front cover is pivotally secured to the top wall of the body and is spring-loaded to close the front opening. The front cover is preferably formed of a clear material such that the operator can visually view the functioning of the device. A handle is fixed to the top wall. A U-shaped handle, which has a sufficiently large opening to permit even a gloved hand, is secured to the top wall for use of the device and permits opening of the cover by the thumb of the user. A raised handle may be provided to permit similar operation of the device from a standing position. The raised handle would include a depressible rod-like member for operating the cover.

4 Claims, 1 Drawing Sheet

FIG. 1
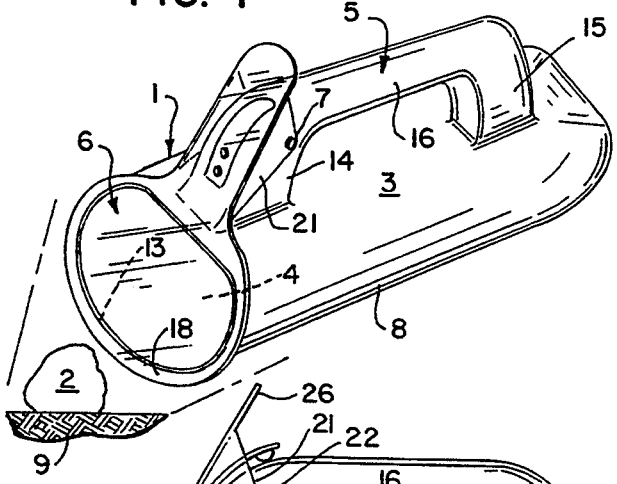
FIG. 5
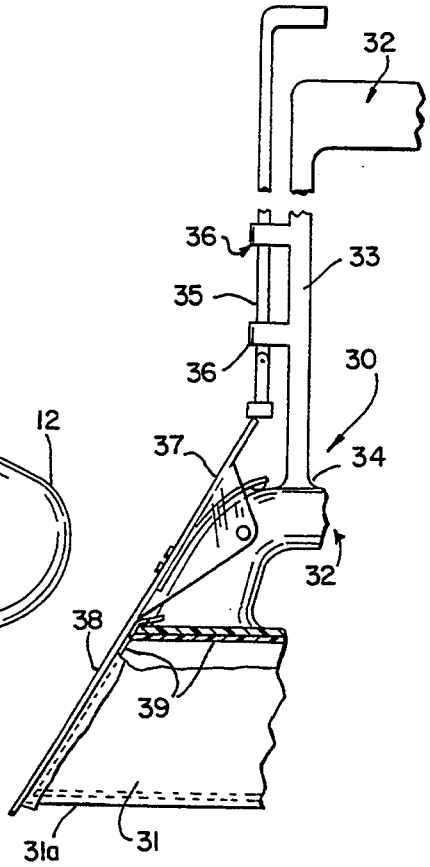
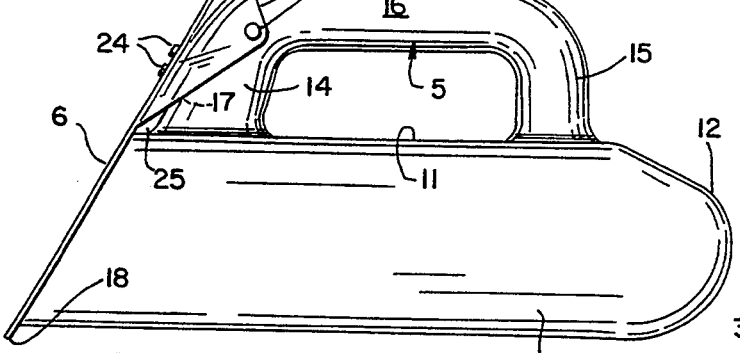
FIG. 2
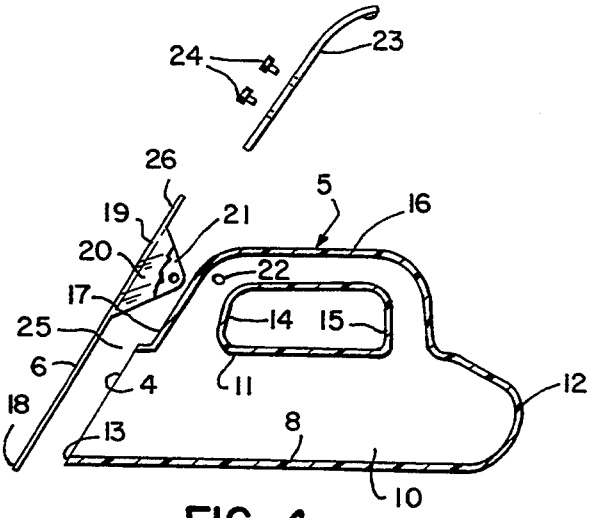
FIG. 4
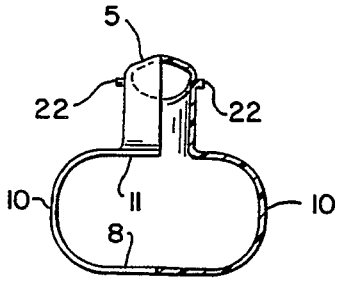
FIG. 3

WASTE PRODUCT COLLECTION DEVICE

This application is a continuation of Ser. No. 07/986,583, filed Dec. 7, 1992, now abandoned.

BACKGROUND OF THE PRESENT INVENTION

This invention relates to a waste product collection device and particularly to such a device for removing of relatively small volumes of waste product from a ground support, such as the excrement of household pets and the like.

A substantial number of different devices for collection of the excrement of pets has been proposed and many are commercially available. Demand for such devices has increased with the increasing governmental ordering of pet owners to pick-up and dispose of the excrement of pets. The presently known devices generally include a scoop-like container with a handle structure which permit the scooping of the excrement or other waste product from the ground while remaining in an upright position. Other devices provide various scoop structures which require the user to bend over in collecting of the waste products. Prior art devices generally have in common a rather small box-like container with a front opening for scooping of the waste product. The front edge structure is rigid and may have a serrated or special rake edge for assisting in the pick-up of the waste product.

Typical prior art structures are shown in the following U.S. patents:

| U.S. Pat. No. | Inventor | Issue Date |
|---|---|---|
| 3,431,008 | Narita | 03/1969 |
| 3,986,744 | Krogstad | 10/1976 |
| 4,021,994 | Mainprice | 05/1977 |
| 4,316,627 | Solypa | 02/1982 |
| 4,641,873 | Nurnberger | 02/1987 |

U.S. Pat. No. 3,986,744 which issued Oct. 19, 1976 is a typical excrement collection unit in which the user bends over and scoops the excrement up by moving of the lower lip of a container along the ground. The patent discloses a rectangular open ended tubular body having a flat bottom wall which constitutes the scoop proper. The body is completed by a pair of sidewalls and a top wall and is formed as a rigid box-like structure open at the opposite ends. A flexible replaceable bag is secured to the back of the tubular body to complete the container and receive the waste product. The forward edge is formed with a comb-like teeth structure for ease of pick-up action and use on a lawn or other type of surface. A cover member is spring loaded to close the front end of the body. A handle structure is secured to the top wall and interconnected to the pivot support of the cover for opening of the scoop device during pick-up and removal of the waste product. The cover is specially constructed to project beyond the lip and function as a paddle for assisting and moving the waste product into the container.

U.S. Pat. No. 4,641,873 which issued Feb. 10, 1987, and U.S. Pat. No. 4,021,994 which issued May 10, 1977 illustrate similar waste pick-up products with a removable container mounted or secured to a supporting frame. An elongated vertical handle structure is provided on a pick-up pan or body to permit manipulation from a standing position of the device including a cover at the lower end. U.S. Pat. No. 4,316,627 which issued Feb. 23, 1982 discloses a fixed body structure with such an elongated handle and pivoted cover in combination with a rake structure which is adapted to protrude forwardly from the rigid body for pick up of the waste product. In this embodiment, the rake-like structure is secured to the front edge of the body and formed by laterally spaced rod-like members. Such device of course could present certain problems with respect to cleaning of the device because of the plurality of members and their interconnection to the body portion.

These and other various devices replace the use of a throw-away plastic bag and glove or the like which has been used picking up and disposing of the waste product into the bag or other container while walking the pet and the like.

The commercially available structures fail to provide a completely satisfactory pick-up system for various reasons. The rigid construction of the pick-up container make use on uneven ground or other like surfaces difficult. Serrated and other tooth-like edges may have a tendency to dig into a surface such as soft ground and interfere with the smooth and easy movement of pick-up of the waste product pick-up device. In addition, such products are somewhat inconvenient with respect to cleaning after each use and the like. The prior art construction may also require a significant final cost, particularly if a long-life reliable device is made and sold.

There is therefore a need and demand for a cost effective waste product pick-up device having a long life with reliable operation.

SUMMARY OF THE PRESENT INVENTION

The present invention is particularly directed to an improved waste product pickup or collection device which is manually manipulative and may be constructed at a reasonable cost, establish ease of use and ease of cleaning. The collection device of this invention includes an open ended body unit having a handle for manipulation and use thereof. The body is specially formed with a lower or bottom wall in which at least the front edge portion is formed as a transverse curved and concave flexible member having a resilient flexible characteristic for conveniently and firmly engaging the ground or other support surface of the waste product for rapid and convenient scooping and pick-up of the waste product. The bottom wall is preferably and conveniently formed as a relatively thin but strong semi-flexible plastic member with an outer or front continuous and smooth edge for optimal and convenient operation in pick-up of the waste product.

More particularly, the pick-up device of the preferred embodiment includes a body formed of a suitable plastic and which is molded or otherwise constructed with a concave bottom wall, sidewalls and a top wall. The body includes a front opening specially formed with an inclined edge to provide a protruding bottom lip portion. The container is conveniently formed of a semi-rigid plastic such that the concave bottom and particularly the forwardly projecting scoop portion has an appropriate flexibility such that by pressing on the top of the body portion, the lower edge is deflected to firmly engage the ground while permitting smooth movement over the ground. The deflected lip portion will thus generally conform to the ground surface and is readily moved over the grass and other surfaces for full pick-up of the waste product.

In a preferred construction, a front cover is pivotally secured to the upper portion, and preferably the top wall, of the body. The cover is spring loaded to close the front opening. A handle is fixed to the top wall and forms a sufficiently large opening to permit even a gloved hand to firmly grasp the handle, and the user may bend over, and open the cover with the user's thumb to recover the waste product. This device may also be provided with a handle structure, either as an optimal attachment or as a separate integrated structure, to permit similar operation of the device from a standing position.

The front cover is preferably formed of a clear material such that the operator can visually view the functioning of the device. In addition, the cover functions as a protective device against splash if the waste product is dumped into a toilet or the like.

The body structure is preferably formed with curved interconnections between all of the walls and a similarly curved rear wall, preferably with a substantially smooth internal surface. The device can then be conveniently cleaned by rinsing with an appropriate solution as necessary.

As an alternative construction, a releasable throw-away bag may be also releasably attached within the scoop body, with any suitable attachment means including a built-in releasable attachment, placing the bag in the body with an outer projecting portion thereof folded back over the front edge opening and the like.

The scoop device of the present invention particularly formed of a suitable total plastic construction provides a highly cost effective and reliable refuse collection device having a long-life and ease of cleaning.

BRIEF DESCRIPTION OF THE DRAWING

The drawing furnished herewith illustrates the best mode embodiments presently contemplated for carrying out the invention, and is fully described hereinafter.

In the drawing:

FIG. 1 is a pictorial view of a waste product collection device constructed in accordance with the teaching of the present invention;

FIG. 2 is a side elevational view of FIG. 1;

FIG. 3 is a front elevational view of the body shown in FIGS. 1 and 2 with half of the body shown in section;

FIG. 4 is an exploded view with the body shown in section; and

FIG. 5 is a fragmentary view of an alternate embodiment.

DESCRIPTION OF THE ILLUSTRATED EMBODIMENT

Referring to the drawing and particularly to FIG. 1, a hand-held scoop or pick-up device 1 for picking up of a waste product 2, such as the excrement of a pet, is illustrated. The scoop device 1 includes a substantially tubular body 3 having a pick-up opening 4 at one end. A handle 5 is secured to the top wall of body 3 and is adapted to be grasped by the hand of the party and conveniently carried while walking a pet or the like. The entrance opening is normally closed by a cover 6. A pivot hinge 7 secures the cover 6 to the tubular body adjacent the handle 5 and is adapted to be actuated and opened by the thumb of the person.

The tubular body 3 is specially constructed with a bottom wall 8 of a slightly concave configuration in an unstressed state, as shown most clearly in FIGS. 1 and 3. The bottom wall 8 is also formed as a resilient, flexible member to permit deformation. To pick up the waste product, the party bends over and drops the pick-up device onto the ground 9 behind product 2 with the cover opened. By pressing downwardly on the body 3 and opening cover 6, the bottom wall 8 deflects to firmly engage the ground 9. The walker then moves the device 1 forwardly along the ground and scoops up the waste product 2 into the tubular body 3, and then releases the cover 6 to trap the waste product within the device. To pick-up successive waste product, one would merely invert the container vertically to drop the existing waste product into the base thereof and then proceed to correspondingly position and move the container to pick up subsequent waste product. The bottom deflection of the bottom wall 8 serves to establish a firm engagement of the front edge of the bottom wall edge of the pick-up opening 4 with the ground area while insuring a smooth movement over the ground to move and capture under the waste product for effective waste product removal.

More particularly, the tubular body of the embodiment shown in FIGS. 1–4 is formed as an essentially integral plastic member which is preferably opaque. The tubular body 3 includes the concave bottom wall 8, curved sidewalls 10, a slightly curved top wall 11 and a cup-shaped end wall 12. The walls are interconnected to each other by smooth curved wall connections to form a generally elliptical cross section, as most clearly shown in FIG. 3, and the curved integrally connected concave rear wall 12 to eliminate any internal corners, recesses or the like areas in which waste product might lodge.

The front pick-up opening 4 is formed with a rearward and planar inclination of the edge to define a forward projecting scoop lip portion 13 in the forward end of the bottom wall 8.

The illustrated handle 5 is a generally U-shaped member having a front and a rear vertical post 14 and 15, integrally formed with the top wall 10 of body 3 and with the horizontal hand grasping portion 16 connected to posts 14 and 15. The posts 14 and 15 locate the handle portion 16 spaced from the body for convenient grasping even with a gloved-hand. The vertical front post 14 is specially formed with an inclined forward wall 17 to provide a somewhat flat wall surface. The angle of the wall 17 is similar to the angular orientation of the front edge opening.

The cover 6 includes a lower portion 18 generally conforming to the configuration and just slightly larger than the pick-up opening 4 so as to preferably overlie and extend slightly beyond the edge of the pick-up opening. An integral cover pivot arm 19 projects upwardly from portion 18 into overlying relationship to the inclined front wall 17 of the handle 5. The arm 19 includes sidewall members 20–21 which project over the sidewalls of the front post 14. Pivot pins 22 extend from the post 14 into the projecting sidewalls 20–21.

The cover 6 is readily formed with the sidewall members with apertures for mounting on the pins 22. The sidewalls of the vertical front post are correspondingly provided with integral nubs or projections to form pins 22 which are appropriately located to support the cover 6 overlying the opening 4. The cover sidewall members 20–21 are deflectable to snap over the pins 22 and align the apertures with the post.

The cover 6 is continuously urged to a closed position. A leaf spring 23 is interposed between the cover arm 19 and the forward post 14. The leaf spring 23, as shown in FIGS. 1 and 4, is a flat, metal member having a lower portion secured to front cover arm 19, as by rivets 24. The leaf spring 23 extends upwardly, generally curved in accordance with the front of the post 14 and the front part of the hand portion 16. The leaf spring 23 is located within gap 25 between the front cover arm 19 and the front post, with the uppermost end terminated in engagement with the upper portion of the handle portion beneath the upper projecting end of arm 19, as at 26 and urges the cover closed. The spring 23 thus pivots the cover portion 18 into abutting engagement with the edge of the pick-up opening 4. The projecting cover arm 19 at the handle allows the operator to engage arm 19 with the thumb to pivot the handle in a clockwise direction as viewed in FIG. 2 for uncovering the pick-up opening of the device for use. This deflects the lower end of spring 23 outwardly relative to the handle abutment and further stresses the leaf spring 23. Upon release of arm 19, the cover 6 is closed by the action of spring 23.

The cover 6 and particularly cover portion 18 is preferably formed of a suitable rigid plastic having a flat planar surface to closely and firmly abut a smooth front edge of the pick-up opening 4. The cover is also preferably formed of a transparent or translucent plastic to give the user a clear view of the pick-up functioning in use.

The present invention thus provides a very convenient device for pick-up of waste product. The user merely bends down with pivoting of the cover to an open position and depresses the front edge scoop portion of the body to establish firm engagement with the ground immediately rearwardly of the waste product. The user then moves the body forwardly, with the deflected lip portion maintained in engagement with the ground to rapidly and cleanly pick-up the waste product 2. Upon return home or other suitable disposable location, it is merely necessary to open the cover 6 and allow the waste product 2 to drop downwardly into a waste receptacle, not shown. The cover 6 is partially opened and functions as a shield against water splash if the waste receptacle includes water or other liquid solution. A cleaning liquid may be placed in the emptied device to flush out the unit and thoroughly clean it as necessary.

The degree of inclination of the front opening for the container body is not critical. In a practical construction, a tubular container having a depth of 3 inches, a width of $4\frac{7}{8}$ inches and a front opening inclination of 60 degrees has been found to provide a totally satisfactory and effective body structure. The tubular container may be conveniently formed of a suitable thermoplastic material such as HDPE (High Density PolyEthylene) material with a thickness of approximately 0.040 inches. The bottom wall has a curvature with a radius of substantially 5 inches. The combination provides a satisfactory bottom wall flexibility which can be readily depressed by the user during the scooping up of the waste product.

The illustrated embodiment of the invention as shown in FIGS. 1–4 provides a highly cost effective and relatively simple waste product collection device which will have a long useful life.

Certain users may find it difficult to bend over in the anticipated use of the device or seriously object to such required action. Alternatively, the device can be provided with an extended built-in handle to permit operation from a standing position, or, as an optional feature to be added to the illustrated embodiment, a removable elongated handle can be readily supplied for attachment to the illustrated embodiment of FIGS. 1–4.

A device 30 operated from a standing position is shown in FIG. 5. The device 30 includes a body 31 having a deflectable bottom wall 31*a* similar to that of the first embodiment. A handle structure 32 includes an elongated post 33 having a bottom attachment 34 attached to the top of body 31. The handle post 33 may be a separate element having a lower end adapted to be attached to the horizontal portion of a handle, such as shown in FIG. 1. A depressible rod member 35 or the like is slidably mounted to the handle post 33 as at 36 and coupled to the top of the cover arm 37 for pivoting the cover 38. The rod member 35 may be mounted with a separate spring unit, not shown, connected to the member 35 and the post 33 to continuously urge the member 35 into engagement with cover 38 to close the cover. The user, from a standing position, would align the bottom lip behind the waste product with the cover fully or partially open, depress the post 33 and rod member 35 and thereby deflect bottom wall 31*a* to again provide firm ground engagement. The user moves the device forwardly in an appropriate manner to scoop up the waste product 2.

An add-on handle structure 32 could include a snap-on handle for releasable coupling to the handle of FIG. 1 for easy attachment and removal. Thus, the structure of FIG. 5 could have the lower end of the post 33 provided with U-shaped spring end for releasable attachment to the handle.

The device can also be used with a suitable disposable bag 39. Thus, a plastic bag, such as those which are presently available for different purposes, is provided with an opening generally corresponding to that of the pick-up opening of the body for replaceable insertion into the body. The outer end of the bag is secured to the forward end of the body and suitably secured in place. For example, the bag may have a folded edge extended back over the opening edge. A suitable bag attachment or securement element would preferably be provided, such as an encircling rubber band or the like which could form a part of the throw-away bag structure as such. Other variations of such a disposable bag structure could of course be used with any type of a separate interconnection for ease of insertion and removal with a disposable bag of suitable strength. The tubular body could be formed without a back wall to receive a bag secured to the back edge, such as generally suggested in previously identified U.S. Pat. No. 3,986,744.

The tubular plastic construction with the integral interconnection and the simple interconnection of a spring loaded cover member such as disclosed provides for maximum ease of cleaning and maintenance. The straight edged lip should provide ease of movement over ground or the like, but a serrated edge may also be provided for the user who anticipates easier operation of the device. Although illustrated in the preferred construction with a single integral body, the structure can be made with separated body parts joined in suitable manner. Other components may also be otherwise constructed to provide illustrated functions. For example, coil or hair pin-type springs may be conveniently located between the post sidewall and the vertical sidewall to insure retention onto the post with the spring members engaging the cover and the stop posts. Hairpin type springs have arms which are conveniently compressed between the cover arm and an abutment on the cover posts to continuously bias the cover closed.

These and other features will, of course, be readily apparent to those skilled in the art.

Various modes of carrying out the invention are contemplated as being within the scope of the following claims particularly pointing out and distinctly claiming the subject matter which is regarded as the invention.

We claim:

1. An animal waste product collection device comprising an elongated tubular body formed as a single integral plastic member with an open end defining a waste receiving opening and a closed end, said body having a bottom wall with a distinct shallow curvature and sidewalls and a top wall, said top wall and said bottom wall having a width substantially greater than the vertical length of said side walls, the receiving opening of said tubular body including said bottom wall extending rearwardly to define a forward deflecting lip portion at the receiving opening, said bottom wall being formed of a deflectable resilient plastic and said sidewalls and top wall are formed sufficiently rigid to establish deflection of said lip portion in response to a force applied to said top wall, a handle secured to said top wall with a horizontal portion close spaced from the top wall to define an opening beneath the horizontal portion of the handle for grasping by the hand of a user immediately adjacent the top wall for moving said tubular body into and over ground engagement under a downward pressure on said handle deflecting said lip portion into a relatively flat tip for picking up of animal waste product by moving of the tubular body through the location of the waste product with the lip portion flattened substantially in the plane of the bottom wall and moving underneath the waste product for picking up the same, said receiving opening having a planar front edge, and a cover pivotally secured to said body and including a planar portion overlying said front edge to effectively close the receiving opening, an upwardly extending portion of said cover aligned with the handle for manual positioning of said cover, a resilient element coupled between said handle and said cover resiliently urging said cover to a closed position overlying and engaging said front edge and movable to an opened position spaced from said front edge, said body is formed as an elongated tubular body formed of a single integral molded plastic having said waste receiving end opening as the only inlet and outlet into said body, said body being formed with continuously smooth and curved surfaces between said side walls and said to wall and bottom wall.

2. The waste collection device of claim 1 including a disposable waste bag adapted to be inserted into said tubular body and including an outwardly projecting bag portion adapted to be wrapped backwardly over the front edge of said receiving opening.

3. The waste collection device of claim 1 wherein said handle includes a forward post extending upwardly from said top wall to said horizontal portion and having laterally spaced sidewalls, said cover having an operating arm projecting upwardly in front of said post and including side arms telescoped over the sidewalls of said post, said post and cover having lateral interengaging openings and pin members pivotally supporting said cover to said post, said resilient element including a spring located between said cover and said handle, said spring having a first end secured to said cover and a second end secured to said post, said spring being stressed to urge said cover to said closed position and being deflectable by a force applied to said operating arm to move said cover to said opened position.

4. The waste collection device of claim 3 wherein said spring is an elongated metal leaf spring, said first end of said metal leaf spring being located in downwardly spaced relation to the upper end of said post and said second end of said leaf spring extending upwardly into alignment with the upper end of said post, said first end of said leaf spring being coupled to said cover and said second end being coupled to said handle and stressed to bias and releasably hold said cover into said closed position engaging the front edge of said waste receiving opening, pivoting of said cover to open said cover stressing said leaf spring whereby upon release of said cover said leaf spring returns the cover to the closed position.

* * * * *

UNITED STATES PATENT AND TRADEMARK OFFICE

CERTIFICATE OF CORRECTION

PATENT NO. : 5,382,063

DATED : January 17, 1995

INVENTOR(S) : Lois D. Wesener et al

It is certified that error appears in the above-identified patent and that said Letters Patent is hereby corrected as shown below:

CLAIM 1, COLUMN 8, LINE 6, delete "to" and substitute therefore ---top---.

Signed and Sealed this

Twenty-eight Day of March, 1995

*Attest:*

BRUCE LEHMAN

*Attesting Officer*

*Commissioner of Patents and Trademarks*